US007239816B2

(12) United States Patent
Ng

(10) Patent No.: US 7,239,816 B2
(45) Date of Patent: Jul. 3, 2007

(54) AUTOMATED IMAGE APPEARANCE CONTROL METHOD

(75) Inventor: Yee S. Ng, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/020,504

(22) Filed: Dec. 21, 2004

(65) Prior Publication Data

US 2005/0135823 A1 Jun. 23, 2005

Related U.S. Application Data

(60) Provisional application No. 60/532,161, filed on Dec. 23, 2003.

(51) Int. Cl.
*G03G 15/00* (2006.01)

(52) U.S. Cl. ..... 399/15

(58) Field of Classification Search ..... 399/15
See application file for complete search history.

(56) References Cited

U.S. PATENT DOCUMENTS 5,234,783 A 8/1993 Ng ..... 430/45
5,678,133 A * 10/1997 Siegel ..... 399/67
5,748,221 A * 5/1998 Castelli et al. ..... 347/232
5,887,223 A * 3/1999 Sakai et al. ..... 399/60
6,163,662 A * 12/2000 Martin et al. ..... 399/45
6,853,815 B2 * 2/2005 Tezuka et al. ..... 399/39

FOREIGN PATENT DOCUMENTS

JP 06175533 A * 6/1994
JP 11084941 A * 3/1999

OTHER PUBLICATIONS

Yee Ng et al., "Gloss Uniformity Attributes fro Reflection Images", NIP17: International Conference on Digital Printing Technologies, pp. 718-722.

* cited by examiner

*Primary Examiner*—Quana Grainger
(74) *Attorney, Agent, or Firm*—Lawrence P. Kessler

(57) ABSTRACT

An input image capture device, capable of sampling the color density and gloss of the fused printed image (thus not requiring the printing of density patches on a separate calibration page), may compare the printed image's color density and gloss to a predicted value. Then, appearance control may be achieved by changing fuser parameters (such as fuser nip width, fuser roller temperature and the like) and other electrophotographic element control parameters (such as exposure, off-set development voltage, charger voltage and the like) to maintain a desirable constant appearance (density, gloss, etc.) of images consistently in print engine usage (within a print run and between print runs), even if different media substrates are used on the same print job. Therefore, no waste calibration sheet is needed, and a print job operator may receive more timely feedback relating to the current printing job stream.

21 Claims, 2 Drawing Sheets

AUTOMATED IMAGE APPEARANCE CONTROL METHOD

CROSS REFERENCE TO RELATED APPLICATION

Reference is made to and priority claimed from U.S. Provisional Application Ser. No. 60/532,161, filed Dec. 23, 2003, entitled IN-LINE APPEARANCE CONTROL METHOD.

FIELD OF THE INVENTION

The present invention generally relates to controlling in-line appearance of a reproduced image and, more specifically, to timely controlling the color density and gloss of a reproduced image while minimizing waste.

BACKGROUND OF THE INVENTION

In high-speed, high-quality electrophotographic printing applications, there are interactions between density (i.e., color gamut) and gloss of the fused images. Moreover, there is a strong influence on the final appearance of the print (i.e., overall gloss, differential gloss) based on the type of media substrate used. In some cases, as shown in U.S. Pat. No. 5,234,783, issued to Ng, the image appearance can also be modified with the addition of a transparent toner overcoat in selected areas.

In a typical printing system, either the transmission density of the toner patches before fusing (if toner patches are laid down in the inter-frame area between paper) is measured from a process control viewpoint, or the reflection density of the fused toner patches on the paper is measured from a process control viewpoint. An in-line gloss measurement device may also be included, to monitor the gloss of fused toner patches on the paper in conjunction with the density measurement. With the gloss and density measurement information and basic document page information (e.g., media substrate type used, color distribution in color management, and digital image content of the printed page), fuser parameters (e.g., fuser nip width and fuser roller temperature) and other electrophotographic element control parameters (e.g., exposure, off-set development voltage, and charger voltage) can be changed to maintain a desirable constant appearance (density, gloss, etc.) of images consistently in print engine usage (within a print run and between print runs), even if different media substrates are used on the same print job.

When a typical process control method is used, one lays down density patches (perhaps including multiple color coverage combination toner patches, rather than only the Dmax (maximum density) color separation patches) on a test sheet. Then, color densities and gloss are measured when the test sheet is diverted to a proof tray, so that the test sheet is out of the mainstream of the printing job flow, which is going to a stacker in a different paper path. Based on measurements of color density and gloss, fuser parameters and electrophotographic element set points may be changed to maintain the desired image appearance.

This conventional practice resolves the issue of off-line linearization that customers once had to perform (although in a non-timely fashion, effecting customer satisfaction because of wasted time) to maintain system quality. However, test sheets (i.e., calibration sheets), that are required to be sent to a proof tray, are considered as waste sheets. Additionally, with conventional methods, further waste sheets are required to have more frequent sampling for more timely control (especially when mixed media and different paper sizes are in the print job stream).

As can be seen, there is a need for improved in-line appearance control that addresses the issue of waste sheets while maintaining the ability for timely appearance control via color density and gloss measurements.

SUMMARY OF THE INVENTION

As will be discussed in more detail below, and in accordance with the present invention, an image gloss value may be predicted for a particular digital image content on a particular media substrate. For example, by estimating the large area gloss and color density that is expected from a printed page in the job stream, gloss and color density can be predicted ahead of time. An input image capture device, capable of sampling the color density and gloss of the fused printed image (thus not requiring the printing of density patches on a separate calibration page), may compare the printed image's color density and gloss to the predicted value. Then, appearance control may be achieved by changing fuser and electrophotographic element parameters. No waste sheet is needed in this case, and a print job operator may receive more timely feedback relating to the current printing job stream.

As used herein, the term "appearance" refers to the color density and gloss of an image or a portion of an image on a fused printed page.

As also used herein, the term "in-line" refers to a measurement or process that is performed without external user intervention. For example, an in-line appearance measurement may measure color density or gloss of a fused, printed image within a printing apparatus prior to releasing the printed page to the user.

As also used herein, the term "patches" refer to various locations of an image from which sampling may occur to determine parameters of the image, such as gloss and color density.

In one aspect of the present invention, a method for controlling an appearance of a printed image on a media substrate provides for measuring at least one of an actual color density and an actual gloss of at least a first measured portion and a second measured portion, respectively, of the printed image; comparing at least one of the actual color density and the actual gloss with a predetermined value of color density and a predetermined value of gloss, respectively; and adjusting the appearance as necessary to bring at least one of the actual color density and the actual gloss closer to the predetermined color density and the predetermined gloss, respectively.

In another aspect of the present invention, a method for controlling an appearance of a printed image on a media substrate provides for calculating a predicted gloss and a predicted color density of at least a predicted portion of the printed image, the calculation based on a digital bit map of the printed image and the media substrate; measuring an actual color density and an actual gloss of at least a measured portion of the printed image; comparing the actual color density with the predicted color density; comparing the actual gloss with the predicted gloss; and adjusting the appearance as necessary to bring at least one of the actual color density and the actual gloss closer to the predicted color density and the predicted gloss, respectively.

In yet another aspect of the present invention, a method for controlling an appearance of a printed image on a media substrate provides for calculating a predicted gloss and a predicted color density of at least a predicted portion of the printed image, the calculation based on a digital bit map of the printed image and the media substrate; measuring a pre-fused color toner transmission density with a transmission densitometer to determine information about toner lay-down prior to the printed image being fused; measuring an actual color density and an actual gloss of at least a measured portion of the printed image; comparing the actual color density with the predicted color density; comparing the actual gloss with the predicted gloss; adjusting the gloss as necessary by changing at least one of a fuser nip width and a fuser roller temperature; and adjusting the color density as necessary by changing at least one of a toner lay-down amount, an exposure, an off-set voltage and a charger voltage.

In a further aspect of the present invention, a method for monitoring printed image quality during a print run without requiring the printing of a calibration sheet provides for calculating a predicted gloss and a predicted color density of at least a strip width of the printed image, the calculation based on a digital bit map of the printed image and the media substrate; measuring an actual color density and an actual gloss of at least the strip width of the printed image; comparing the actual color density with the predicted color density; comparing the actual gloss with the predicted gloss; and adjusting the appearance as necessary to bring at least one of the actual color density and the actual gloss closer to the predetermined color density and the predetermined gloss, respectively.

In still a further aspect of the present invention, a device for controlling an appearance of a printed image on a media substrate includes a control unit allowing user input of a predicted gloss and a predicted color density of at least a predicted portion of the printed image, the predicted gloss and predicted color density being based on a digital bit map of the printed image and the media substrate; a color densitometer for measuring an actual color density of at least a first measured portion of the printed image; and a gloss meter for measuring an actual gloss of at least a second measured portion of the printed image; wherein said control unit compares the actual color density with the predicted color density, compares the actual gloss with the predicted gloss, and adjusts the appearance as necessary to bring at least one of the actual color density and the actual gloss closer to the predicted color density and the predicted gloss, respectively.

In still another aspect of the present invention, a computer readable media for controlling an appearance of a printed image on a media substrate includes a code segment for measuring an actual color density of at least a first measured portion of the printed image; a code segment for measuring an actual gloss of at least a second measured portion of the printed image; a code segment for comparing the actual color density with a predetermined value of color density; a code segment for comparing the actual gloss with a predetermined value of gloss; and a code segment for adjusting the appearance as necessary to bring at least one of the actual color density and the actual gloss closer to the predetermined color density and the predetermined gloss, respectively.

These and other features, aspects and advantages of the present invention will become better understood with reference to the following drawing, description, and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Broadly, the present invention provides timely controlling of the color density and gloss of a reproduced image while minimizing waste. By measuring in-line the color density and gloss of the output pages and comparing this output to a predicted color and gloss output (based upon, among other things, digital image content, media substrate, and the like), the printing system may adjust certain parameters to change the gloss and color density of the printed pages to approach that of the predicted gloss and color density. Unlike conventional systems for gloss and color density control, the system of the present invention may eliminate the need to generate calibration pages, which are then discarded by the printing system operator.

The ability to predict image gloss value has been previously described in publication "Gloss Uniformity Attributes for Reflection Images", Proceedings of IS&T's NIP17 International Conference on Digital Printing Technologies, pp. 718–722, 2001, by Ng et al. and herein incorporated by reference in its entirety. The Ng publication uses a neural network type of calculation to predict gloss from a combination of multiple color toner coverage generated by a digital bit map on different types of media.

The present invention may predict a large area gloss and color density on any given printed page in the job stream to give a predicted printed page gloss value and a predicted printed page color density value. An input image capture device may then sample the color density and gloss of the fused printed image to give a measured printed page gloss value and a measured printed page color density value.

Figure 1:
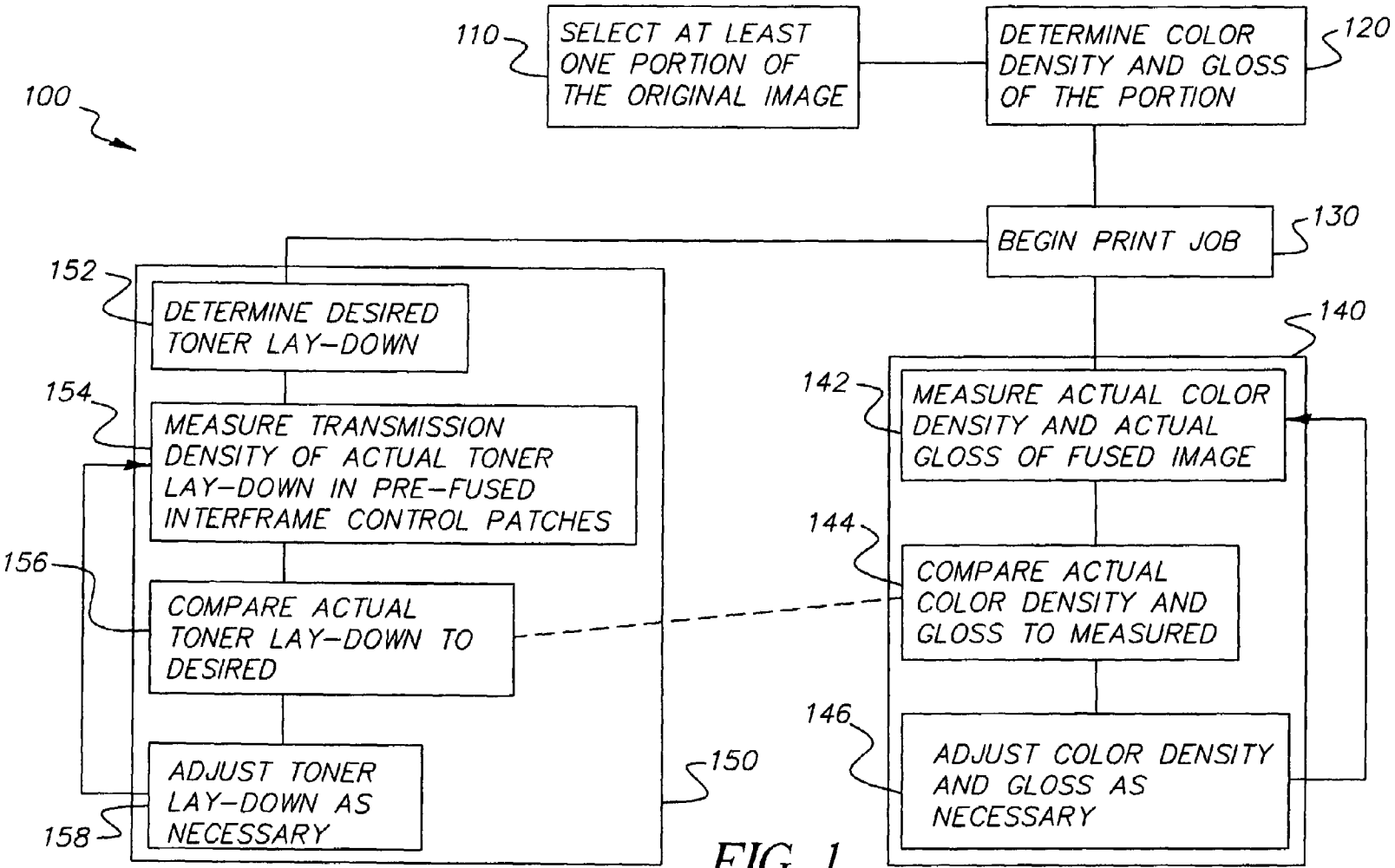
FIG. 1 shows a flow chart of one embodiment of an in-line appearance control method according to the present invention.

Referring to FIG. 1, there is shown a flow chart of an in-line appearance control method 100 according to an embodiment of the present invention. The method begins at step 110 by selecting at least one portion (i.e., a predicted portion) of the original image to determine its gloss and color density. This calculated, predicted pre-determined value for gloss and color density may be obtained at step 120, for example, from a digital bit map of the original image, as described in the Ng publication (gloss) mentioned above and via many color management systems (for color density estimation).

Once the print job is started at step 130, a main appearance control loop 140 may measure, at step 142, the actual color density, and the actual gloss of the fused printed page. These actual measurements may be obtained from at least one strip width (i.e., a measured portion) of the printed page. In an embodiment, each of these measurements (color density and gloss) may be made on the same measured portion. This measured portion may also correspond to the predicted portion of the original image from which the calculated, predicted values of color density and gloss were obtained.

The actual color density and the actual gloss may then be compared to the predicted color density and the predicted gloss of the digital bit map image at step 144. Additional information relating to refining the determination of the root cause of the color density change by toner lay-down change and/or fuser condition change can be input from step 156 (described below). As discussed in more detail below, at least one of the color density and the gloss may be adjusted at step 146, as necessary, to bring the actual color density value and/or the actual gloss value closer to the predicted color density value and the predicted gloss value, respectively. The measurement of actual color density and actual gloss of the fused printed page continues periodically and adjustments are made as necessary.

An optional appearance control loop 150 begins at step 152 by first determining the desired toner lay-down for the interframe process control patches.

Once the print job is started, optional appearance control loop 150 may measure, at step 154, the actual toner-lay down of the interframe process control patches by measuring the transmission density of the measured portion.

The actual toner lay-down may then be compared to the predicted toner lay-down at step 156. As discussed in more detail below, the toner lay-down may be adjusted at step 158, as necessary, to bring the actual toner lay-down closer to the predicted toner lay-down. The information from 156 may optionally be fed to 144, as shown by the dotted line in FIG. 1. The measurement of toner lay-down of the pre-fused printed page continues periodically and adjustments are made as necessary. As can be appreciated by this method, the user is not required to generate any waste calibration pages in order to perform measurements of color density and gloss. The information relating to toner actual toner lay-down in step 156 (via transmission density measurement of interframe control patches) can be optionally fed to step 144 to refine the control of density and gloss for the actual bitmap image.

Figure 2:
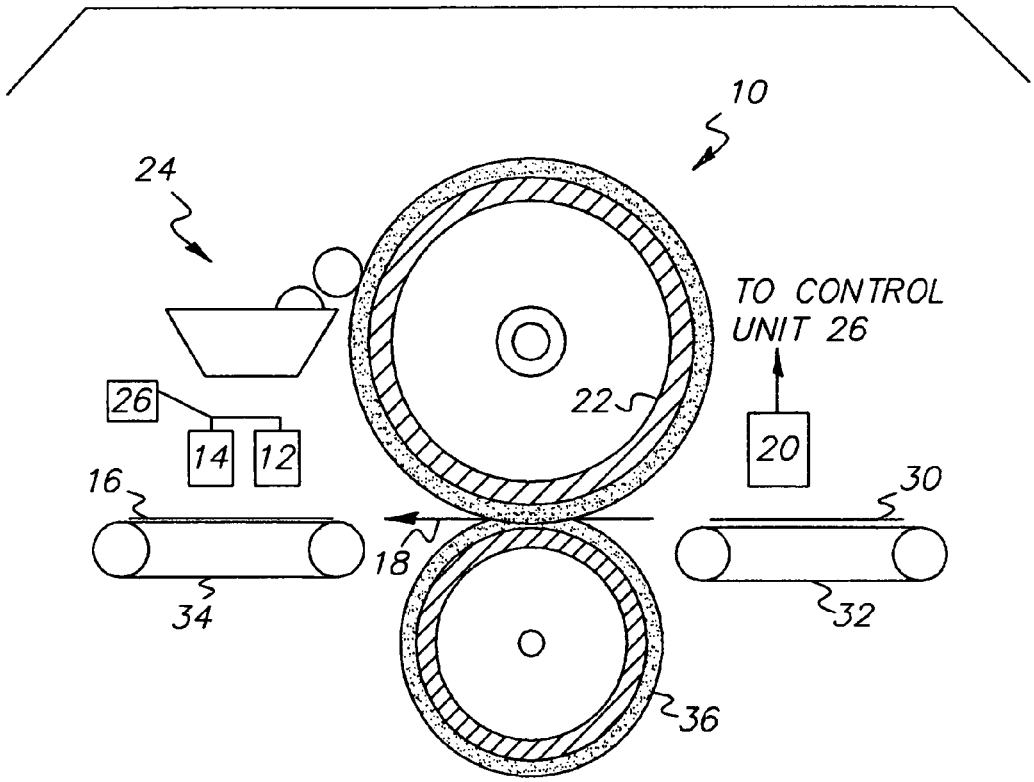
FIG. 2 shows a schematic view of a printing apparatus according to the present invention.

Referring now to FIG. 2, there is shown a printing apparatus 10 that may have an in-line gloss meter 12 and color densitometer 14 according to the present invention. In one example, there may be a printed page 16 having printed color density patches with single color separation as well as combined multi-color separation on the printed page 16. Paper 30 may be fed along a paper path 18 defined by an input paper feeder 32, through a nip formed between a fuser roller 22 and a pressure roller 36, and an output paper feeder 34. Along paper path 18, there may be disposed gloss meter 12 and color densitometer 14, or perhaps a single unit having both a gloss meter and a color densitometer (not shown) that may monitor the gloss and color density on the printed page 16. Monitored values of gloss and color density may be sent to a control unit 26.

Control unit 26 may be controlled by computer code stored in a computer readable media. The computer code may contain a code segment for obtaining the measurements of the actual color density and/or the actual gloss of the printed image. The computer code may also contain a code segment for comparing the actual measurements with a digital bit map of the original image to determine if there are any discrepancies there between. Finally, the computer code may contain a code segment for adjusting the appearance, if necessary, to bring at least one of the actual color density and the actual gloss closer to a predetermined value of color density and gloss taken from the digital bit map of the original image.

Optionally, an additional gloss meter (not shown) and/or an additional color densitometer (not shown) may be disposed on the other side of printed page 16 to measure the color density and gloss on both the top side, and the bottom side of the page. In this two-sided measurement configuration, it is desirable that there be an off-set in the top side and bottom side positions of the gloss meter 12 and/or color densitometer 14 in order to avoid light penetration to the other side when thin media may be used.

Color densitometer 14 may assume a known color filters set (such as Status A) in front of (or on) the density sensors (not shown) within color densitometer 14, and further may assume a known toner colorant set so that both the fused toner gloss and the color density of the patches can be measured. (Or a color spectra-photometer can be used to determine the toner colorant set). A transmission densitometer 20 may be used to measure inter-frame color toner transmission density to obtain information of the amount of toner lay-down in the electrophotographic process before the fusing step. This measured toner lay-down value may be compared to a predicted value of toner lay-down (as discussed above) to adjust actual toner lay-down as necessary to maintain optimal appearance of the printed page.

EXAMPLES

In one example of the present invention, one of the color separation densities, such as that for cyan, may be low (~0.1 density off from Cyan Dmax), and the gloss sensitivity of the four-color 280% black may also be low. The gloss value of the red (yellow and magenta), yellow, magenta, and black may also be used to determine whether the overall gloss setting is correct. If the gloss setting is correct, but cyan density is low, then only the cyan density may need to be adjusted upward. There is no need to change the fuser nip to change the gloss value. Further confirmation of this low cyan density may come from supplemental transmission density measurements of the pre-fused image as measured by transmission densitometer 20.

In the above example, however, the overall gloss value for all the patches may show an indication of gloss change from its preset value (for example, all the Dmax and high toner coverage (above about 150% toner coverage) patches gloss are lowered), but not all the color density steps are desaturated. In addition, transmission densitometer may indicate that the transmission density of the patches is not coming down in the fusing process. In this case, the fuser nip may need to be increased to increase the global gloss value and to maintain the appearance of the printed page. This aspect of the present invention can be used to compensate for fuser roller 22 long-term gloss change due to wear, or shorter-term gloss change due to fuser oil 24 rate changes in relationship to the printed media use.

In another example, if more than one color separation density (for example, magenta and cyan) is a little low (~0.1 density lower than expected) or one color separation density (for example, cyan) is much lower (~>0.2 density lower than expected), the gloss sensitivity of the higher coverage steps may still be usable (depending on how sensitive the gloss to coverage curve is). The system may use this information to control either the gloss or the separation density, or both, as needed to return the printed page closer to the calculated values for gloss and color separation density.

According to another example of the present invention, from the perspective of measuring the gloss, it may be sufficient to make use of a larger area average gloss as a reference, since sampling a smaller region at high speed can have lower accuracy. The gloss difference between the calculated reference and the actual measured image gloss may be recorded. At the same time, the large area color density may also be recorded. If the overall color density shows a color separation deficiency (such as lack of cyan density), and as yet, the average gloss is about right, then, in conjunction with the transmission density on pre-fused image in the inter-frame, one can determine to increase cyan density without changing nip width to increase gloss. However, if the average gloss value changes, but it is determined that color density is not an issue, the fuser nip width may be changed to maintain gloss. Of course, combination issues of gloss and color density, as discussed above, can occur and may require both gloss and density changes at the same time to maintain the desired image appearance of gloss and color density.

One problem that may be an issue is if, within the strip where color density and gloss is measured, there happens to be no toner lay-down or lack of toner lay-down for a particular color separation. Because we have prior knowledge of the imaging data of the whole printed page, the system may print out a step tablet and send that to the proof tray, thereby maintaining image appearance in those special circumstances. Alternatively, in these situations, it may be possible to use a full width gloss and color density meter that samples many strips, albeit at low resolution, along the printed image. This method would more likely find adequate toner lay-down for each particular color separation.

It should be understood, of course, that the foregoing relates to exemplary embodiments of the invention and that modifications may be made without departing from the spirit and scope of the invention as set forth in the following claims.

PARTS LIST

10 printing apparatus
12 gloss meter
14 color densitometer
16 printed page
18 paper path
20 transmission densitometer
22 fuser roller
24 fuser oil
26 control unit
30 paper
32 input paper feeder
34 output paper feeder
36 pressure roller

What is claimed is:

1. A method for controlling an appearance of a printed image on a media substrate comprising:

measuring at least one of an actual color density and an actual gloss of at least a first measured portion and a second measured portion, respectively, of the printed image;

comparing at least one of the actual color density and the actual gloss with a predetermined value of color density and a predetermined value of gloss, respectively; and adjusting the appearance as necessary to bring at least one of the actual color density and the actual gloss closer to the predetermined color density and the predetermined gloss, respectively, wherein the first measured portion and the second measured portion are the same portion of the printed image, and wherein the first measured portion and the second measured portion comprise a multiple strip width along a width of the printed page.

2. A method for controlling an appearance of a printed image on a media substrate comprising:

measuring at least one of an actual color density and an actual gloss of at least a first measured portion and a second measured portion, respectively, of the printed image;

comparing at least one of the actual color density and the actual gloss with a predetermined value of color density and a predetermined value of gloss, respectively;

adjusting the appearance as necessary to bring at least one of the actual color density and the actual gloss closer to the predetermined color density and the predetermined gloss, respectively; and measuring a pre-fused color toner transmission density to determine information about toner lay-down prior to the printed image being fused.

3. A method for controlling an appearance of a printed image on a media substrate comprising:

calculating a predicted gloss and a predicted color density of at least a predicted portion of the printed image, the calculation based on a digital bit map of the printed image and the media substrate;

measuring an actual color density and an actual gloss of at least a measured portion of the printed image;

comparing the actual color density with the predicted color density;

comparing the actual gloss with the predicted gloss; and adjusting the appearance as necessary to bring at least one of the actual color density and the actual gloss closer to the predicted color density and the predicted gloss, respectively.

4. The method according to claim 3, further comprising:

adjusting the gloss by changing at least one of a fuser nip width and a fuser roller temperature; and adjusting the color density by changing at least one of a toner lay-down amount, an exposure, an off-set voltage and a charger voltage.

5. The method according to claim 3, further comprising measuring a pre-fused color toner patch transmission density to determine information about toner lay-down prior to the printed image being fused.

6. The method according to claim 3, wherein the measured portion and the predicted portion are the same portion of the printed image.

7. The method according to claim 6, wherein the measured portion and the predicted portion is a strip width of the printed image.

8. A method for controlling an appearance of a printed image on a media substrate comprising:

calculating a predicted gloss and a predicted color density of at least a predicted portion of the printed image, the calculation based on a digital bit map of the printed image and the media substrate;

measuring a pre-fused color toner patch transmission density to determine information about toner lay-down prior to the printed image being fused;

measuring an actual color density and an actual gloss of at least a measured portion of the printed image;

comparing the actual color density with the predicted color density;

comparing the actual gloss with the predicted gloss;

adjusting the actual gloss as necessary by changing at least one of a fuser nip width and a fuser roller temperature; and adjusting the actual color density as necessary by changing at least one of a toner lay-down amount, an exposure, an off-set voltage and a charger voltage.

9. A method for monitoring printed image quality during a print run without requiring the printing of a calibration sheet comprising:

calculating a predicted gloss and a predicted color density of at least a strip width of the printed image, the calculation based on a digital bit map of the printed image and the media substrate;

measuring an actual gloss and an actual color density of at least the strip width of the printed image;

comparing the actual color density with the predicted color density;

comparing the actual gloss with the predicted gloss; and adjusting the appearance as necessary to bring at least one of the actual color density and the actual gloss closer to the predetermined color density and the predetermined gloss, respectively.

10. The method according to claim 9, further comprising:

adjusting the gloss by changing at least one of a fuser nip width and a fuser roller temperature; and adjusting the color density by changing at least one of a toner lay-down amount, an exposure, an off-set voltage and a charger voltage.

11. The method according to claim 10, further comprising measuring a pre-fused color toner patch transmission density to determine information about toner lay-down prior to the printed image being fused.

12. The method according to claim 11, wherein the measured portion and the predicted portion are the same portion of the printed image.

13. The method according to claim 12, wherein the measured portion and the predicted portion is a strip width of the printed image.

14. The method according to claim 9, wherein the gloss meter and the color densitometer are integrally formed in a single unit.

15. A device for controlling an appearance of a printed image on a media substrate comprising:

a control unit allowing user input of a predicted gloss and a predicted color density of at least a predicted portion of the printed image, the predicted gloss and predicted color density being based on a digital bit map of the printed image and the media substrate;

a color densitometer for measuring an actual color density of at least a first measured portion of the printed image;

a gloss meter for measuring an actual gloss of at least a second measured portion of the printed image; and wherein said control unit compares the actual color density with the predicted color density, compares the actual gloss with the predicted gloss, and adjusts the appearance as necessary to bring at least one of the actual color density and the actual gloss closer to the predicted color density and the predicted gloss, respectively.

16. The device according to claim 15, wherein the first measured portion of the printed page is the same as the second measured portion of the printed page.

17. The device according to claim 15, wherein:

said control unit adjusts the gloss by changing at least one of a fuser nip width and a fuser roller temperature; and said control unit adjusts the color density by changing at least one of a toner lay-down amount, an exposure, an off-set voltage and a charger voltage.

18. The device according to claim 15, further comprising a transmission densitometer for measuring a pre-fused toner transmission density to determine information about toner lay-down prior to the printed image being fused.

19. The device according to claim 15, wherein said gloss meter and said color densitometer are integrally formed in a single unit.

20. A computer readable media for controlling an appearance of a printed image on a media substrate comprising:

a code segment for measuring an actual color density of at least a first measured portion of the printed image;

a code segment for measuring an actual gloss of at least a second measured portion of the printed image;

a code segment for comparing the actual color density with a predetermined value of color density;

a code segment for comparing the actual gloss with a predetermined value of gloss;

a code segment for adjusting the appearance as necessary to bring at least one of the actual color density and the actual gloss closer to the predetermined color density and the predetermined gloss, respectively; and a code segment for determining the predetermined color density and the predetermined gloss by calculating a predicted gloss and a predicted color density of at least a predicted portion of the printed image, the calculation based on a digital bit map of the printed image and the media substrate.

21. The computer readable media according to claim 20, further comprising a code segment for measuring a pre-fused color toner transmission density with a transmission densitometer to determine information about toner lay-down prior to the printed image being fused.

* * * * *